United States Patent [19]

Base

[11] 4,062,551

[45] Dec. 13, 1977

[54] CABLE SEAL UNIT FOR EARTH-BORING DRILL STRINGS

[76] Inventor: Jim Base, 41 Eastern Avenue, Caister-on-Sea, Norfolk, England

[21] Appl. No.: 638,278

[22] Filed: Dec. 5, 1975

[51] Int. Cl.[2] ..... F16J 15/06

[52] U.S. Cl. ..... 277/102; 277/110; 339/94 R

[58] Field of Search ..... 277/110, 102, 123; 339/94 R, 103 R, 103 C, 103 M

[56] References Cited

U.S. PATENT DOCUMENTS

| | | | |
|---|---|---|---|
| 2,091,054 | 8/1937 | Petrie | 339/103 C |
| 2,312,579 | 3/1943 | O'Brien | 277/110 |
| 2,533,897 | 12/1950 | Reddock | 339/103 C |
| 3,113,999 | 12/1963 | Heikkinen | 277/110 |
| 3,490,775 | 1/1970 | Henshaw | 277/110 |
| 3,879,097 | 4/1975 | Oertle | 339/94 R |

*Primary Examiner*—Richard E. Aegerter
*Assistant Examiner*—L. Footland
*Attorney, Agent, or Firm*—Burgess, Ryan and Wayne

[57] ABSTRACT

The unit comprises a hollow cylindrical shell in the wall of which is formed an aperture through which an electrical cable passes. The cable thus passes from the ground surface on the outside of the drill string, but enters into the interior of the drill string through the aperture and continues to the bottom of the drill string inside the drill string. The aperture around the cable is sealed to withstand the high pressures present in the interior of the drill string.

8 Claims, 3 Drawing Figures

CABLE SEAL UNIT FOR EARTH-BORING DRILL STRINGS

Figure 1:
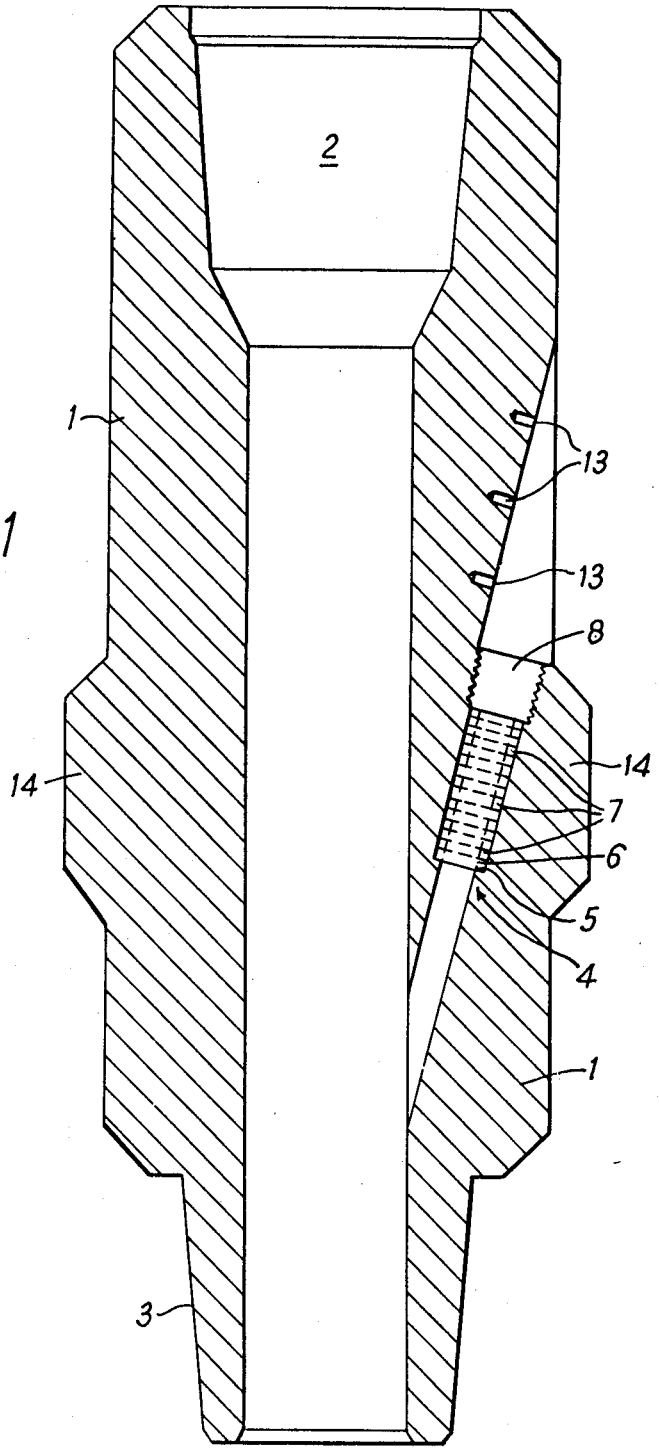

The present invention relates to a cable seal unit for earth-boring drill strings. The invention is particularly applicable for use in drill strings for oil or gas wells.

When drilling such wells, it is frequently necessary to send electrical cables down the hollow drill string for the purposes of supplying instruments for monitoring the position and orientation of the drilling bit and for controlling the drilling bit itself. Such cables are passed down the hollow interior of the pipes making up the drill string and thus if, for any reason, it is desired to continue drilling while the cable is in place, it is necessary to withdraw the cable each time the string descends sufficiently for it to be necessary to fit a new pipe section at the upper end. Such tedious withdrawal of the cable is time consuming and costly.

This situation exists particularly when it is desired to change direction whilst drilling. As a matter of practice, the position of the drill bit is monitored at intervals throughout the drilling operation so that any errors can be corrected. If an error in the position of the drill bit becomes apparent, or if it is desired to change direction, the drill string is withdrawn, and the normal drill bit is removed and replaced by a down hole mud motor. Such mud motors, which are well known in the art, are operated by a motor located at the bottom of the drill string. During the correction run or kick off which ever the case may be, the direction of the tool face may be monitored at the surface through the use of an instrument commonly known as a steering tool and the direction of drilling can be altered to whatever is desired. Once the steering operation has been completed, the drill string is once more withdrawn and the normal drill bit is replaced to continue the drilling.

In practice it has been found that a fairly considerable depth has to be drilled in order to correct an error - longer, in fact, than the overall length of the individual drilling pipe sections. Thus the steering operation cannot be completed without the necessity for fitting a new pipe section. It is therefore necessary, during the course of the steering operation, to withdraw the cable one or more times in order to provide the necessary depth to complete the steer. The present invention seeks to obviate this disadvantage.

According to the invention there is provided a cable seal unit for an earth-boring drill string, said unit comprising a hollow cylindrical shell, means for fitting said shell intermediate two adjacent pipe sections in a drill string so that the shell forms a substantially continuous assembly with the string, the wall of said shell being formed with an aperture through which a cable may pass from the interior to the exterior of the shell, and sealing means for sealing the aperture around the cable.

The aperture is preferably angled at an acute angle with respect to the axis of the shell so that the cable is not caused to pass through sharp angles.

The sealing means may be of any type, bearing in mind the very considerable pressures which may build up in the interior of the string — and hence the shell. A pressure of 2000 p.s.i. is typical. In one embodiment of the invention, the interior end of the aperture is of smaller diameter than the remainder, thus forming a shoulder at the interface. Against this shoulder is placed a suitable packing material which is then compressed from outside the shell, for example by means of an externally threaded packing nut which operates in a thread formed in the exterior end of the aperture. One example of a suitable packing material is a stack of split rubber or neoprene rings, the splits of which are staggered within the stack. A further alternative is to use a piece of continuous graphite-impregnated fibre material which is wound into the aperture. A combination of the above may also be used. Still further suitable packing materials will be apparent to those skilled in the art.

In order to prevent damage to the shoulder region of the aperture, due to the high pressure, it has been found preferable to include a removable packing seat intermediate the shoulder in the aperture and the packing itself. Such a packing seat, which may be made of brass, can be removed and replaced should damage become apparent.

Figure 2A:
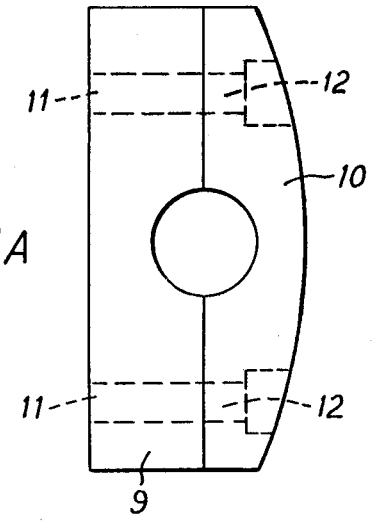
Figure 2B:
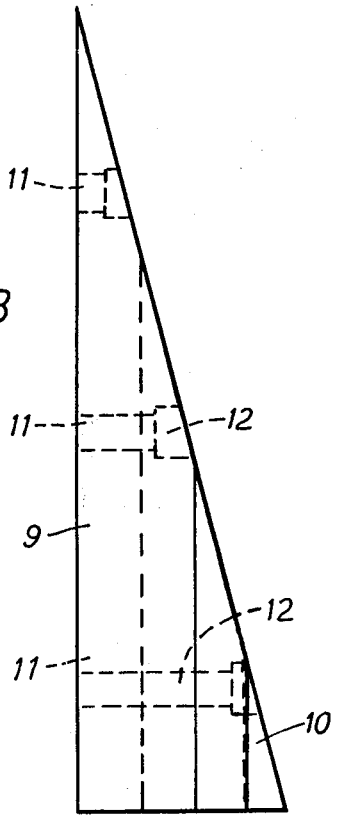

In order that the invention may be better understood, an embodiment thereof will now be described by way of example only and with reference to the accompanying drawings in which:

FIG. 1 is a sectional side view of a cable seal unit according to the invention; and FIGS. 2A and 2B show respectively an enlarged underside and cross sectional view of a cable clamp for use with the cable seal unit of FIG. 1.

Referring to FIG. 1, the unit comprises a hollow cylindrical shell 1 of steel having a female threaded portion 2 at its upper end and a male threaded portion 3 at its lower end, for enabling the unit to be attached to adjacent pipe sections with a drill string (not shown). The shell is dimensioned so that, when fitted, it forms a substantially continuous assembly with the remainder of the drill string. If desired the diameter of the shell may be made slightly larger than that of the remainder of the string so that the unit is easily identifiable. In a typical example, the outside diameter of the shell is 6¼ inches, this diameter corresponding to that of the connection collars (not shown) between each pipe section of the string.

A circular aperture 4 is formed in the wall of the shell 1, the axis of the aperture being angled at an angle of 15° with respect to the axis of the shell. The inner part of the aperture is of smaller diameter, thus defining a shoulder 5 against which the packing is pressed. In use of the unit, the packing is spaced from the shoulder by means of a packing seat in the form of a brass collar whose position is shown by dotted lines under reference 6. The collar protects the edges of the shoulder 5 from being eaten away. The packing consists of a stack of split rings of rubber or neoprene, whose position is shown by dotted lines under reference 7. The direction of the slit in each ring 7 is at an angle to the radial direction and the position of the slits is angularly staggered from ring to ring.

The packing is compressed against the packing seat by means of an annular packing nut (not shown) which is threaded around its peripheral edge to co-operate with a threaded outer portion 8 of the aperture 4. The packing nut may be rotated by any conventional means, for example by means of an Allen key.

The internal diameter of the collar 6, split rings 7 and packing nut are chosen to suit the particular cable to be used.

In use, a cable to be sealed passes through the aperture 4 from the interior to the exterior of the drill string. When the cable has been installed, and the collar 6, rings 7 and packing nut are in position, the assembly is secured by a wire cable clamp, shown in detail in FIGS.

2A and 2B. The clamp consists of two halves 9, 10 which fit around the cable and are secured thereon by countersunk screws (not shown) which pass through coaxial apertures 11, 12 in the halves 9 and 10 respectively and screw into threaded apertures 13 in the shell 1 to thereby securely grip the cable. The halves 9 and 10 of the clamp are shaped as shown in FIG. 2 in order that, when fitted, the exterior contour of the shell 1 is relatively unaffected in the region of the clamp. The clamp is spaced above the packing nut.

The shell 1 is formed with a portion 14 of increased diameter in order to protect the cable in the event of the unit coming into contact with the side of the bore.

The manner in which the unit is used will now be described in relation to its use in conjunction with a steering tool.

The normal cutting bits are rotated from above the surface, the whole drill string being rotated to drive the bit. However, if it is desired to change direction for any reason it is necessary to withdraw the string, remove the bit, and replace it with a mud motor (not shown) operated by means of a motor located at the bottom of the string. Thus, while steering, the drill string itself does not rotate.

When the mud motor has been fitted, the drill string is once more lowered into the bore, with the cable for controlling the drill motor passing up the interior of the string. In the present invention, this cable is first passed through the aperture 4 in the cable seal unit, the cable being a loose fit in the aperture. The protective brass collar and the packing nut are also slipped over the cable. In order to allow the cable to be lowered without snagging, the shell 1 may be fitted in a jig (not shown) which tilts it to one side so that the aperture 4 is vertical. The cable may then pass freely therethrough.

Once the cable has been paid out to the extent necessary, the shell 1 is attached to the top of the drill string to form a continuation thereof. The packing rings are not slipped over the cable and are positioned with the protective collar in aperture 4 before being compressed by means of the packing nut to form a gas tight seal. The final positions of the collar and packing rings are shown by dotted lines under reference 6 and 7 respectively. Further pipe sections may be attached above the shell 1 as necessary. The cable from the steering bit motor, now emerges from the interior of the pipe at the position of the cable seal unit, and continues to the surface in the interspace between the drill string and the lining of the bore. Th steering tool is operated to steer the bore around a corner so as to take up the desired direction. As the steering operation is carried out, additional pipe sections may be added as necessary above the shell 1 without the necessity of withdrawing the cable each time a fresh pipe section is added.

When the steering operation is complete, the cable and drill string are withdrawn and the normal drilling bit is replaced. As the cable seal unit emerges from the ground, the packing nut is unscrewed and the packing removed. Thereafter, the cable is withdrawn as before, preferably with the shell once more placed in its jig so that the axis of the aperture 4 is vertical.

The drilling operation now continues as before with the normal bit.

Further modifications may be made to the above described cable seal unit. For example, an alternative form of sealing means may comprise a sealed bag made of flexible material and of annular shape, similar to a motor vehicle inner tube. In use, the bag surrounds the cable as it passes through the aperture 4 and is packed with grease. The grease within the bag is pressured to expand the bag, thus effectively sealing the cable as it passed through the aperture 4. It has been found that the bag can be pressurised up to 10,000 lbs. per sq. in. using a conventional grease gun. The above described sealed bag takes the place of the split rings 7.

I claim:

1. A cable seal unit for coupling a cable to an earth-boring drill string, said unit comprising a cylindrical shell having an axially oriented hollow interior, said shell having opposed, coaxially aligned end portions, one of which is internally threaded and the other of which is externally threaded, for fitting said shell intermediate two adjacent pipe sections in a drill string so that the shell forms a substantially continuous assembly with the string, a wall of said shell having an aperture inclined at an acute angle to the shell axis, through which aperture a cable may pass from the interior to the exterior of the shell, sealing means for sealing the aperture around the cable, said shell having an external recess communicating with said aperture, and means adjacent said recess for securing to said shell a cable clamp which may surround said cable and be disposed in said recess; and wherein the interior end of the aperture is of smaller diameter than the remainder, thus defining a shoulder at the interface, said unit further comprising an annular packing seat positioned against said shoulder, and wherein said sealing means comprises a packing material which is compressed against the packing seat; and further including a cable clamp which is attachable to the shell wall by said securing means.

2. A cable seal unit as claimed in claim 1 wherein the packing seat is removable so that it can be replaced when worn or damaged.

3. A cable seal unit as claimed in claim 1 wherein the packing material comprises an annular bag of resilient material which is filled with grease and pressurised to seal the aperture around the cable.

4. A cable seal unit as claimed in claim 1 wherein the packing material comprises a piece of continuous graphite-impregnated fibre material which is wound into the aperture.

5. A cable seal unit as claimed in claim 1 wherein the acute angle is on the order of 15°.

6. A cable seal unit as claimed in claim 1 wherein said cable clamp is positioned in said recess and is shaped so as to substantially conform to the cylindrical exterior surface of the shell.

7. A cable seal unit as claimed in claim 6 wherein the cable clamp comprises two members which surround the cable and screw means for clamping the two members together with the cable inbetween and attaching the clamp to the shell wall.

8. A cable seal unit as claimed in claim 6 wherein the diameter of the shell is enlarged near said recess.

* * * * *